US006008577A

United States Patent [19]

Rasmussen et al.

[11] Patent Number: 6,008,577

[45] Date of Patent: Dec. 28, 1999

[54] FLAT PANEL DISPLAY WITH MAGNETIC FOCUSING LAYER

[75] Inventors: Robert T. Rasmussen, Boise; Charles M. Watkins; Surjit S. Chadha, both of Meridian, all of Id.

[73] Assignee: Micron Technology, Inc., Boise, Id.

[21] Appl. No.: 08/980,637

[22] Filed: Dec. 1, 1997

Related U.S. Application Data

[63] Continuation of application No. 08/599,437, Jan. 18, 1996, abandoned.

[51] Int. Cl.[6] ..... H01J 1/30; H01J 1/54

[52] U.S. Cl. ..... 313/496; 313/497; 313/422; 313/309; 313/336; 430/25; 445/58

[58] Field of Search ..... 313/495, 496, 313/497, 336, 309, 351, 402, 403, 493, 422, 582, 584; 430/25, 26; 445/47, 24, 58

[56] References Cited

U.S. PATENT DOCUMENTS

| | | | |
|---|---|---|---|
| 2,625,734 | 1/1953 | Law | 48/31 |
| 2,797,172 | 6/1957 | Mears | 117/13 |
| 2,920,959 | 1/1960 | Hull | 96/35 |
| 3,406,068 | 10/1968 | Law | 96/36.1 |
| 3,665,241 | 5/1972 | Spindt et al. | 313/351 |
| 3,753,759 | 8/1973 | Bouchard et al. | 117/33.5 |
| 3,755,704 | 8/1973 | Spindt et al. | 313/309 |
| 3,812,559 | 5/1974 | Spindt et al. | 29/25.18 |
| 3,856,525 | 12/1974 | Inoue | 96/36.1 |
| 3,875,442 | 4/1975 | Wasa et al. | 313/193 |
| 3,921,022 | 11/1975 | Levine | 313/309 |
| 4,233,623 | 11/1980 | Pavliscak | 358/59 |
| 4,320,418 | 3/1982 | Pavliscak | 358/240 |
| 4,325,002 | 4/1982 | Kobale et al. | 313/493 |
| 4,622,497 | 11/1986 | Miyama et al. | 315/366 |
| 4,663,559 | 5/1987 | Christensen | 313/336 |
| 4,707,633 | 11/1987 | Hoshi | 313/402 |
| 4,829,211 | 5/1989 | Van Roosmalen et al. | 313/402 |
| 5,063,327 | 11/1991 | Brodie et al. | 313/495 |
| 5,070,282 | 12/1991 | Epsztein | 315/383 |
| 5,186,670 | 2/1993 | Doan et al. | 445/24 |
| 5,214,350 | 5/1993 | Remec et al. | 313/477 R |
| 5,397,969 | 3/1995 | Roussel et al. | 315/382 |
| 5,399,238 | 3/1995 | Kumar | 156/643 |
| 5,412,277 | 5/1995 | Chen | 313/414 |
| 5,465,024 | 11/1995 | Kane | 313/309 |
| 5,663,611 | 9/1997 | Seats et al. | 313/584 |
| 5,717,292 | 2/1998 | Jin et al. | 313/582 |

OTHER PUBLICATIONS

Yokoo et al., "Active Control of Emission Current of Field Emitter Array", Revue, "Le Vide, les Couches Minces", Supp. #271, Mar.–Apr. 1994, pp. 58–61.

Curtin, "The Field Emission Display . . . ", Conference Record of the 1991 International Display Research Conference, pp. 12–15 (Oct. 15–17, 1991).

*Primary Examiner*—Michael Day
*Attorney, Agent, or Firm*—Hale and Dorr LLP

[57] ABSTRACT

A flat panel display includes a magnetic material for focusing electrons onto a faceplate or phosphors of each pixel on a screen. In one embodiment, a display screen includes a faceplate having a magnetic material (30) deposited thereon. In an alternate embodiment, a field emission display including a substrate (11) with a cathode conductor (12); electron emitting tips (13) disposed over the cathode conductor (12); an insulator (14) disposed around the electron emitting tips (13); a conductive gate (15) over the insulator (14); and a magnetic material layer (19) for focusing electrons emitted from the emitting tips (13).

16 Claims, 5 Drawing Sheets

FLAT PANEL DISPLAY WITH MAGNETIC FOCUSING LAYER

CROSS-REFERENCES TO RELATED APPLICATION

This application is a continuation of Ser. No. 08/599,437, filed Jan. 18, 1996, now abandoned.

This invention was made with Government Support under Contract No. DABT63-93-C-0025 awarded by Advanced Research Projects Agency (ARPA). The Government has certain rights in this invention.

FIELD OF INVENTION

This invention relates to field emission devices, and more particularly to the focusing of emitted electrons onto phosphor elements of pixels of field emission devices.

BACKGROUND OF THE INVENTION

Cathode ray tube (CRT) displays, such as those commonly used in desk-top computers screens, function as a result of a scanning electron beam from an electron gun, impinging on phosphors of a relatively distant screen. The electrons increase the energy level of the phosphors. When the phosphors return to their normal energy level, they release the energy from the electrons as photons of light, which is transmitted through the glass screen of the display to the viewer.

Field emission displays seek to combine cathodoluminescent-phosphor technology with integrated circuit technology to create thin, high resolution displays wherein each pixel is activated by a plurality of electron emitters. This type of display technology is becoming increasingly important in appliances requiring lightweight portable screens. A promising technology is the use of a matrix-addressable array of cold cathode emission devices to excite phosphors on a screen.

U.S. Pat. No. 3,875,442, entitled "Display Panel" discloses a field emission device and more specifically discloses a display panel comprising a transparent gas-tight envelope, three main planar electrodes which are arranged within the gas-tight envelope parallel with each other. The three main electrodes are the emitter tip electrode, the grid electrode and the anode electrode, or cathodoluminescent panel. The cathodoluminescent panel may consist of a transparent glass plate, a transparent electrode formed on the glass plate, and a phosphor layer coated on the transparent electrode. The phosphor layer is made of, for example, zinc oxide which can be excited with low energy electrons. This structure is depicted in FIG. 1.

Field emission cathode structures are discussed in U.S. Pat. Nos. 3,665,241, 3,755,704, and 3,812,559. To produce the desired field emission, a potential source is provided with its positive terminal connected to the gate, or grid, and its negative terminal connected to the emitter electrode (cathode conductor substrate). The potential source may be variable for the purpose of controlling the electron emission current. Upon application of a potential between the electrodes, an electric field is established between the emitter tips and the low potential anode grid, thus causing electrons to be emitted from the cathode tips through the holes in the grid electrode. An array of points in registry with holes in low potential grids are adaptable to the production of cathodes subdivided into areas containing one or more tips from which areas emissions can be drawn separately by the application of the appropriate potentials thereto.

The clarity or resolution of a field emission display is a function of a number of factors including emitter tip sharpness, alignment and spacing of the gates, or grid openings, which surround the tips, pixel size, anode to cathode spacing, as well as-cathode-to-gate and cathode-to-screen to-screen voltages. These factors are also interrelated. Another factor which affects image sharpness is the coincidence of emitted electron strikes on the anode and the location of the desired phosphor pixel.

The distance (d) that the emitted electrons must travel from the baseplate to the faceplate is typically on the order of several hundred microns. The contrast and brightness of the display are optimized when the emitted electrons impinge on the phosphors located on the cathodoluminiscent screen, or faceplate, at a substantially 90 degree angle. If the electrons are not focused in some way upon the faceplate, especially in the case of a large d, then the initial electron trajectories will assume a substantially conical pattern having an apex angle of roughly 30 degree which detrimentally effects the contrast and brightness of the display. Moreover, the space-charge effect results in columbic repulsion among emitted electrons which tends to increase dispersion within the electron beam, as depicted in FIG. 1.

U.S. Pat. No. 5,186,670 which is hereby incorporated by reference, assigned to the present applicant, discloses a process for the formation of self-aligned gate and focus ring structures around the cold cathode emitter tip which function to collimate the emitted electrons so that the beam impinges on a smaller spot on the display screen and thus results in improved display contrast and clarity. In addition, U.S. Pat. No. 5,070,282 entitled, "An Electron Source of the Field Emission Type", discloses a "controlling electrode" placed downstream of the "extracting electrode".

SUMMARY OF THF, INVENTION

This invention is directed to a field emission display panel having a faceplate comprising a magnetic material. The magnetic material focuses the electrons or electron beam onto the phosphors of the pixels. This invention is also directed to a field emission device having a baseplate cathode for emitting electrons and a faceplate anode. The faceplate includes a magnetic material for focusing the electrons onto the anode. Moreover, the invention is directed to a field emission display screen for focusing electrons thereon comprising phosphors and a magnetic material. In addition, the invention is directed to a flat panel display having a baseplate and a faceplate comprising a baseplate having an electron emitter, and a gate comprised of magnetic material to focus the electrons or electron beam onto the phosphors of the pixels on the faceplate.

BRIEF DESCRIPTION OF THE DRAWINGS

The present invention will be better understood by reading the following description of nonlimitative embodiments, with reference to the attached drawings, wherein like parts in each of the several figures are identified by the same reference character, and which are briefly described as follows.

DETAILED DESCRIPTION OF THE INVENTION

Figure 1:
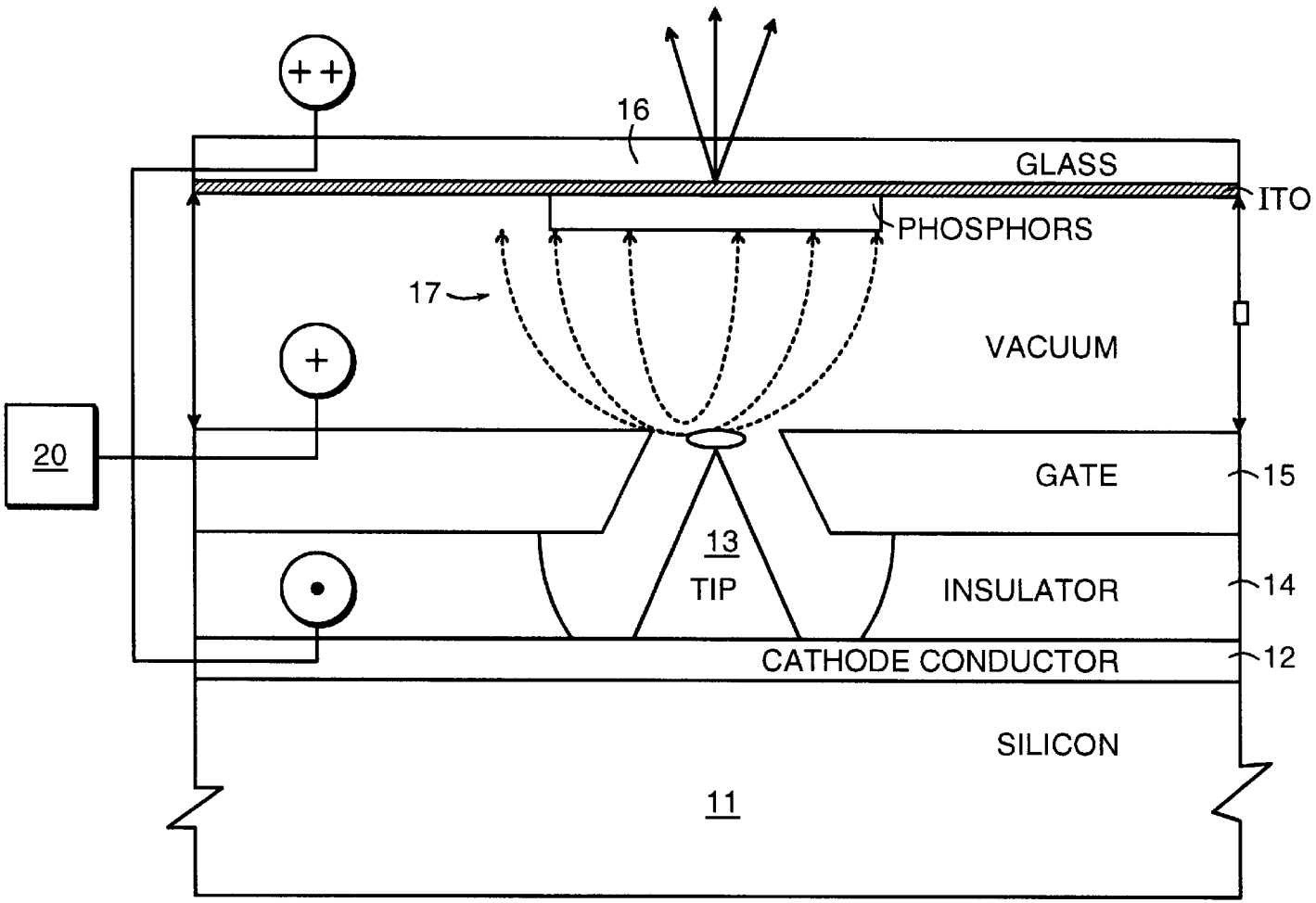
FIG. 1 (PRIOR ART)
FIG. 1 is a cross-sectional schematic drawing of a flat panel display showing a field emission cathode which lacks the magnetic material of the present invention.

Referring to FIG. 1, a field emission display employing a cold cathode is depicted. The substrate 11 can be comprised of glass, for example, or any of a variety of suitable materials. In a preferred embodiment, a single crystal silicon layer serves as substrate 11 onto which a conductive material layer 12, such as doped polycrystalline silicon, has been deposited. At a field emission site location, a conical microcathode 13 (also referred to herein as an emitter tip) has been constructed on top of substrate 11. Surrounding the microcathode 13, is a low potential gate structure 15. When a voltage differential, through source 20, is applied between cathode 13 and gate 15, an electron stream 17 is emitted toward a phosphor coated screen 16. The screen 16 functions as an anode. The electron stream 17 tends to be divergent, becoming wider at greater distances from the tip of cathode 13. The electron emission tip 13 is integral with the single crystal semiconductor substrate 11, and serves as a cathode conductor. Gate 15 serves as a low potential gate or grid structure for its respective cathode 13. A dielectric insulating layer 14 is deposited on the conductive cathode layer 12. The insulator 14 also has an opening at the field emission site location.

Figure 2:
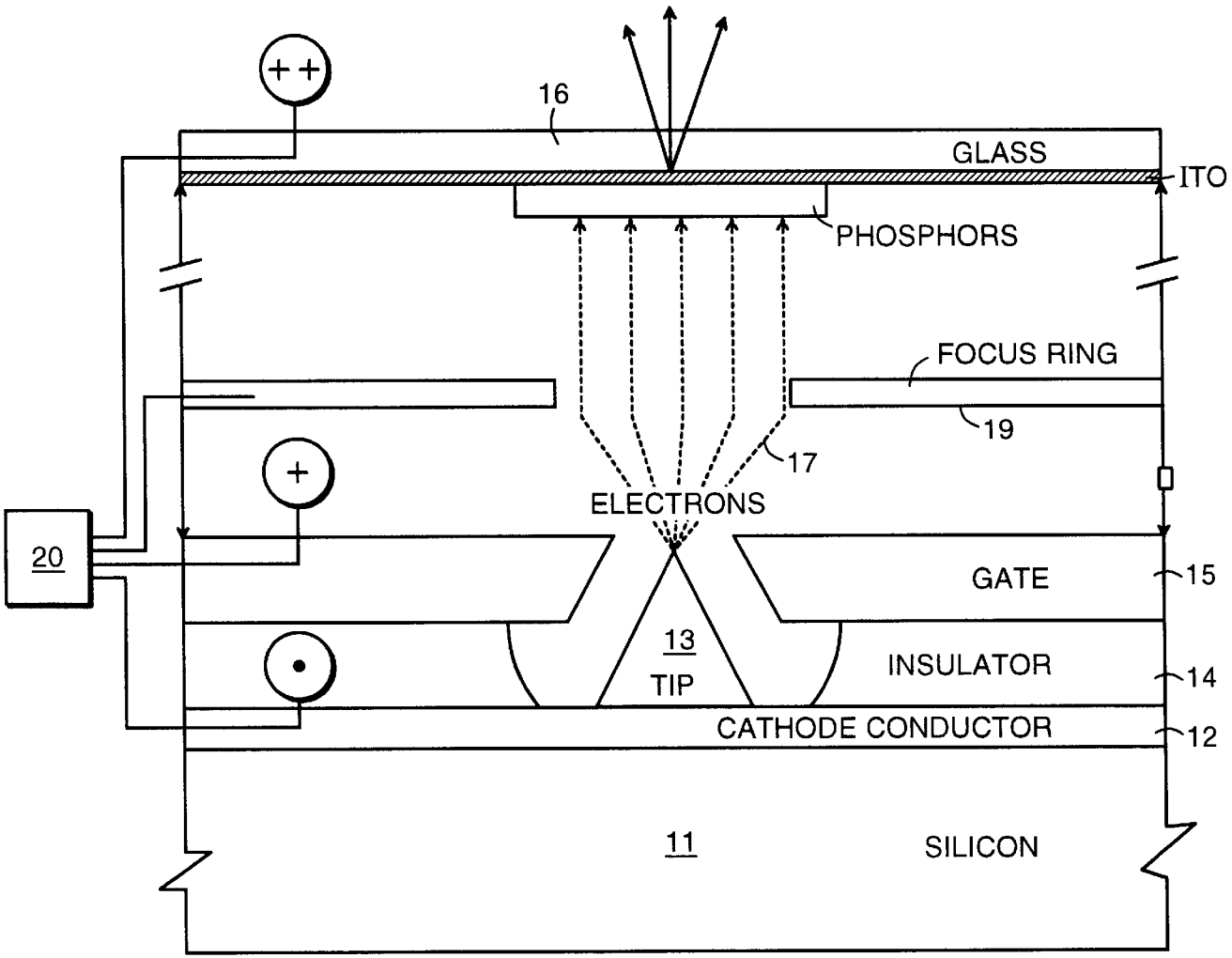
FIG. 2 (PRIOR ART)
FIG. 2 is a cross-sectional schematic drawing of a flat panel display showing a prior art electron beam focusing ring.
Figure 3:
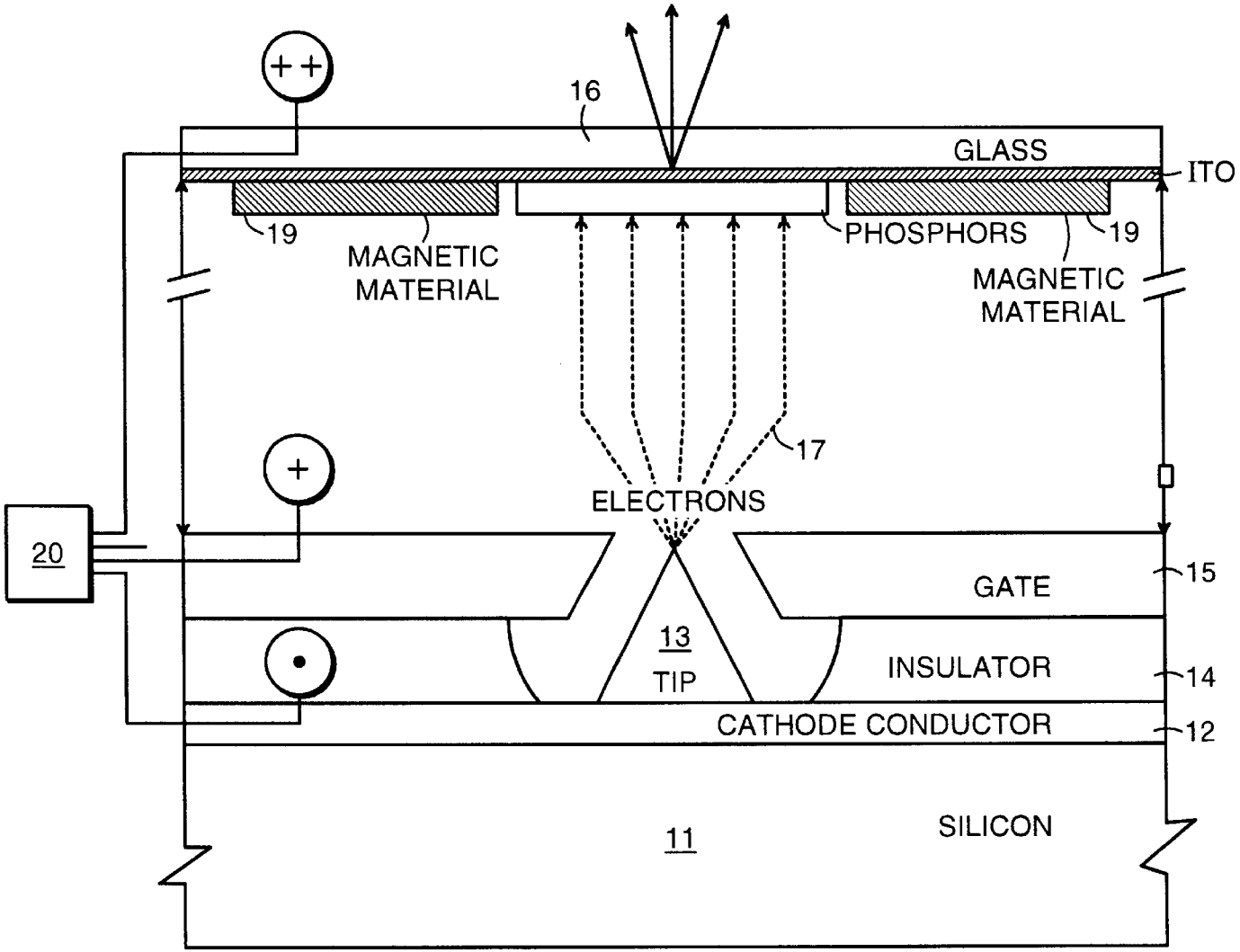
FIG. 3 is a cross-sectional schematic drawing of a flat panel display like shown in FIG. 1, further depicting the magnetic material of the present invention and its result on the electron beam.

Referring to FIG. 2, the cathode structure of FIG. 2 is similar to FIG. 1; however, beam collimating focus ring structures 19 fabricated using the process described in U.S. Pat. No. 5,186,670 are also depicted. The focus rings 19 collimate the electron beam 17 emitted from each cathode so as to reduce the area of the spot where the beam impinges on the phosphor control 16, thereby improving image resolution and color purity. The cathode structure of FIG. 3 is similar to FIG. 1; however, beam collimating magnetic material 19 is also depicted. The magnetic material 19 collimates or focuses the electron beam 17 emitted from each cathode so as to reduce the area of the spot where the beam impinges on the phosphor coated screen 16 thereby improving image resolution and color purity.

Figure 4:
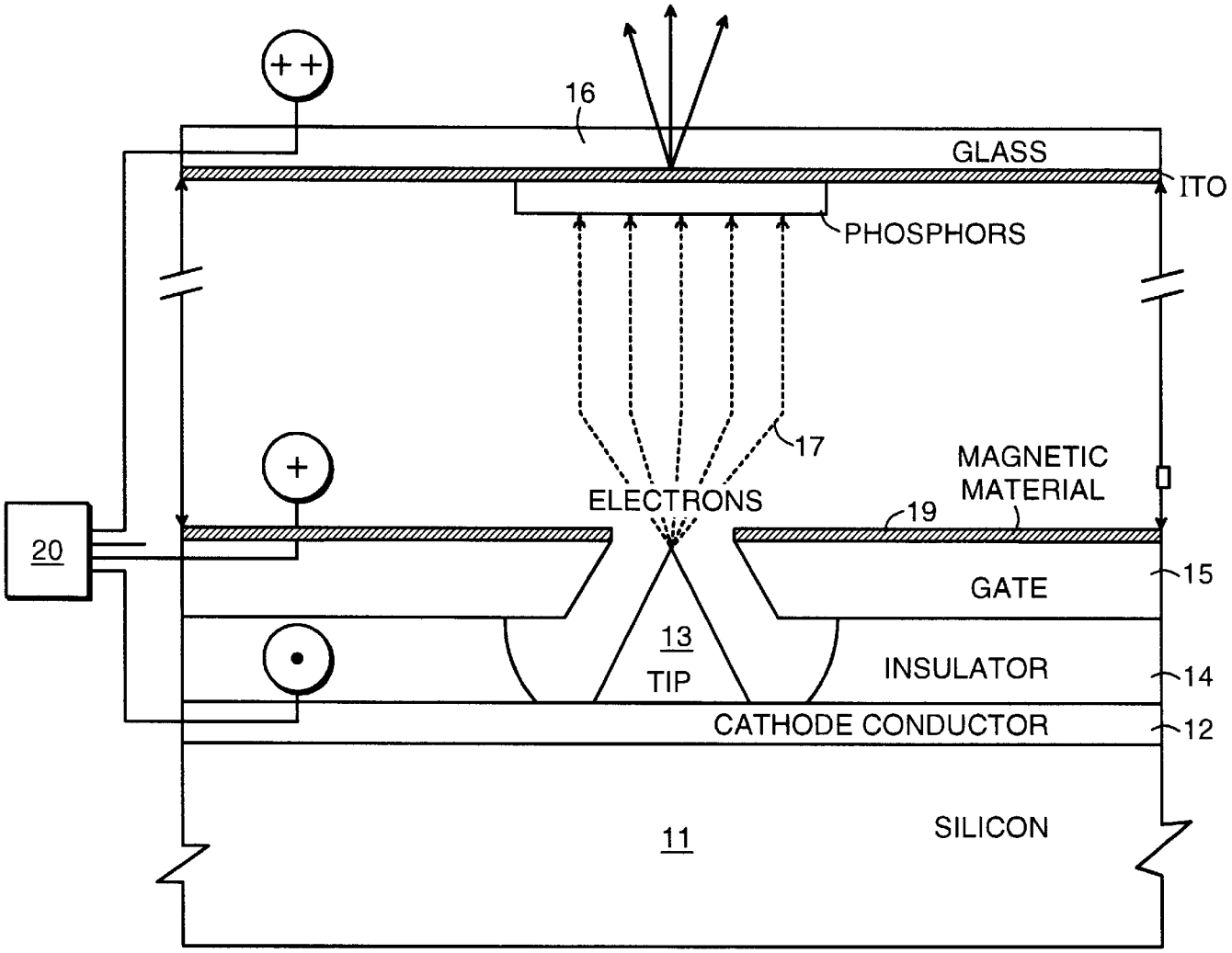
FIG. 4 is a cross-sectional schematic drawing like shown in FIG. 1, further depicting the S magnetic material of the present invention located on the gate and the result on the electron beam.

The cathode structure of FIG. 4 is similar to FIG. 1; however, beam collimating magnetic material 19 is also depicted on gate 15. The magnetic material 19 therefore collimates or focuses the electron beam 17 emitted from each cathode so as to reduce the area of the spot where the beam impinges on the phosphor coated screen 16 thereby improving image resolution.

The phosphors are coated and/or applied to screen 16 in any conventional manner known in the art. For example, see U.S. Pat. Nos. 3,856,525; 3,406,068; 2,920,959; 2,625,734; 3,753,759 and 2,797,172 all of which are hereby incorporated by reference. The present invention relates to all phosphors known in the art, e.g., those disclosed in U.S. Pat. No. 4,233,623 which is hereby incorporated by reference.

It is also generally desirable to apply a nonluminescent, light absorbing, or opaque masking material in between or around the phosphors to improve the contrast of the display. In some field emission devices, the masking material may be applied to the inside of the screen as a coating and dried. The coating may be comprised of conventional materials known in the art.

Figure 5:
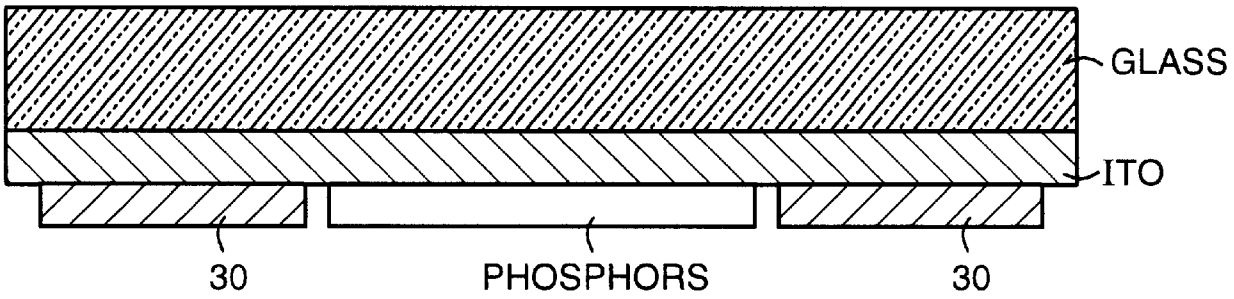
FIGS. 5 and 6 are cross-sectional views of faceplates according to alternative embodiments.
Figure 6:
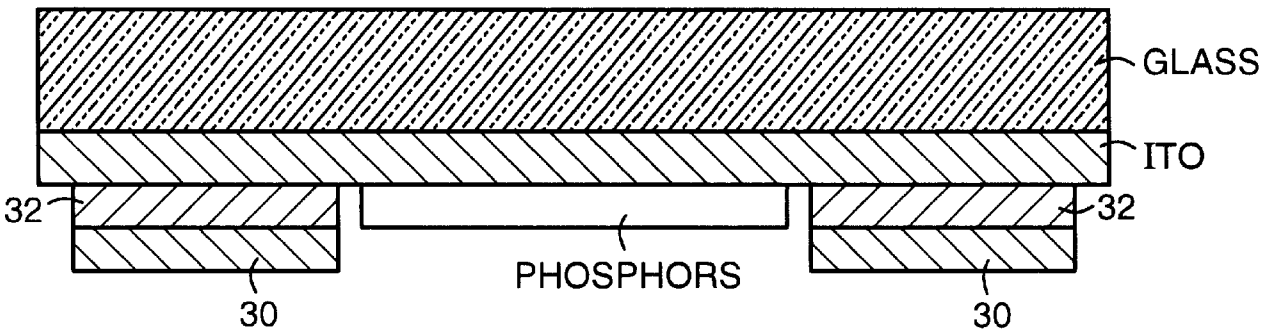

The invention of the present application includes the addition of a magnetic material around or in the vicinity of the phosphors on the faceplate to improve the contrast and brightness of the display by having an effect on the trajectories of the electron beams onto the phosphors. The magnetic materials useful in the practice of the present invention include iron oxide, cobalt oxide, iron, nickel, nickel oxide and samarium cobalt alloys. The amount of magnetic material used is dependent upon the specific magnetic material chosen. Generally, sufficient quantities of magnetic material should be used to have an effect on the beams of electrons in the desired manner while still obtaining the desired contrast and clarity of the display. The magnetic material 30 may be applied as the masking material (FIG. 5) and/or may be applied on top of and in addition to the masking material 32 in between and around the phosphors (FIG. 6).The magnetic material may be screen printed, electrophoretically deposited, thin film deposited, powder deposited, sputter deposited, and/or evaporation deposited, i.e., by techniques known in the art.

While the invention is acceptable to various modifications in alternate forms, specific embodiments have been shown by way of example and have been described in detail herein. However, it should be understood that the invention is not intended to be limited to particular embodiments disclosed. Rather, the invention is to cover all modifications, equivalents and alternatives falling within the spirit and the scope of the invention as defined by the appended claims.

We claim:

1. A display screen for a flat panel display comprising:

a transparent substrate;

a transparent conductive layer formed over the substrate;

phosphors formed on the conductive layer;

a masking material around the phosphors; and a magnetic material formed on the masking material, the magnetic material for focusing electron beams received by the display screen.

2. The display screen of claim 1, wherein the magnetic material is selected from the group consisting of samarium cobalt, iron oxide, cobalt oxide, iron, nickel, nickel oxide, and cobalt.

3. A flat panel display having a display screen as in claim 1, and a baseplate having a substrate, a conductive layer over the substrate, electron emitting tips over the conductive layer, an insulating layer around the electron emitting tips, a conductive gate layer over the insulating layer, and a power source coupled to the conductive layer and the conductive gate layer.

4. The display of claim 3, wherein the substrate includes glass and the conductive layer includes indium tin oxide.

5. The display screen of claim 1, wherein the substrate includes glass and the conductive layer includes indium tin oxide.

6. A flat panel display including a baseplate with a cathode including a substrate, a conductive layer formed over the substrate, electron emitting tips over the cathode conductor, an insulator around the electron emitting tips, a conductive gate over the insulator, a power source coupled to the conductive gate and to the cathode conductor layer, and a layer of material over the gate, wherein the material is a magnetic material selected and positioned to focus electrons emitted from the emitting tips.

7. The display of claim 6, wherein the magnetic material is selected from the group consisting of samarium cobalt, iron oxide, cobalt oxide, iron, nickel, nickel oxide, and cobalt.

8. In a flat panel display device having a faceplate with a transparent substrate, a transparent conductive layer over the transparent substrate, phosphor regions on the transparent conductor layer, and a masking material on the transparent conductive layer and around the phosphor regions, a method for making a flat panel display including providing an additional layer of magnetic material over the masking material.

9. The method of claim 8, wherein the magnetic material is selected from the group consisting of samarium cobalt, iron oxide, cobalt oxide, iron, nickel, nickel oxide, and cobalt.

10. In a field emission display having a substrate, a conductive layer over the substrate, a plurality of emitter tips over the conductive layer, an insulator around the emitter tips, and a gate electrode over the insulator, a method for making a flat panel display including providing a layer of magnetic material over the gate electrode, the magnetic material selected and positioned to focus electrons emitted from the emitter tips.

11. The method of claim 10, wherein the magnetic material is selected from the group consisting of samarium cobalt, iron oxide, cobalt oxide, iron, nickel, nickel oxide, and cobalt.

12. A flat panel display comprising:

a faceplate including:

a substrate;

a conductive layer over the substrate;

a magnetic material on the conductive layer, and the magnetic material defining pixel regions and being provided to focus electron beams received by the display screen.

13. The display of claim 12, wherein the magnetic material is selected from the group consisting of samarium cobalt, iron oxide, cobalt oxide, iron, nickel, nickel oxide, and cobalt.

14. The display of claim 12, further comprising a baseplate having a substrate, a conductive layer over the substrate, electron emitting tips over the conductive layer, an insulating layer around the electron emitting tips, and a conductive gate layer over the insulating layer.

15. The display of claim 12, wherein the substrate is glass.

16. The display of claim 12, wherein the conductive layer is indium tin oxide.

* * * * *